US007186122B2

(12) United States Patent
Haga

(10) Patent No.: US 7,186,122 B2
(45) Date of Patent: Mar. 6, 2007

(54) SNAP ELECTRODE, ITS BONDING METHOD AND USING METHOD

(75) Inventor: Tsuyoshi Haga, Ako-gun (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/514,828

(22) PCT Filed: Apr. 4, 2003

(86) PCT No.: PCT/JP03/04371

§ 371 (c)(1),
(2), (4) Date: Nov. 17, 2004

(87) PCT Pub. No.: WO03/098753

PCT Pub. Date: Nov. 27, 2003

(65) Prior Publication Data

US 2005/0176277 A1 Aug. 11, 2005

(30) Foreign Application Priority Data

May 17, 2002 (JP) ..... 2002-142902

(51) Int. Cl.
*H01R 12/00* (2006.01)
*H05K 1/00* (2006.01)

(52) U.S. Cl. ..... 439/82; 439/342

(58) Field of Classification Search ..... 439/82, 439/844, 853, 342, 861, 860
See application file for complete search history.

(56) References Cited

U.S. PATENT DOCUMENTS 1,696,616 A * 12/1928 Wappler ..... 439/844
3,383,648 A * 5/1968 Tems ..... 439/844
5,411,400 A 5/1995 Subrahmanyan et al.
6,129,559 A 10/2000 Hirata et al.

FOREIGN PATENT DOCUMENTS

| | | |
|---|---|---|
| EP | 1 174 885 | 1/2002 |
| JP | 63-51069 | 3/1988 |
| JP | 3-29139 | 4/1991 |
| JP | 3-29139 B2 | 4/1991 |
| JP | 10-189168 | 7/1998 |
| JP | 2001-102141 | 4/2001 |
| JP | 2002-212770 | 7/2002 |

OTHER PUBLICATIONS

Office Action dated Apr. 7, 2006 issued in the corresponding Finnish patent application No. 20041464 and English translation thereof.
Search Report dated Mar. 23, 2006 issued in the corresponding Finnish patent application No. 20041464.
"Retrospects and Prospects of Plating in the Electronics Industry", Xia Chuanyi, vol. 33, No. 3 Jun. 1996, with English abstract.

* cited by examiner

*Primary Examiner*—Javaid H. Nasri
(74) *Attorney, Agent, or Firm*—McDermott Will & Emery LLP

(57) ABSTRACT

An object of the present invention is to provide an electrode for high-density connection capable of attachment/detachment of a package or an FPC. In order to attain this object, a snap electrode according to the present invention has a tubular ring presenting a circular or polygonal section and at least one spring electrode provided in the ring and coupled to the ring, to be connected to a substrate or an FPC by holding a pin electrode of an insertion-mount type package or the FPC with the spring electrode. The snap electrode preferably consists of nickel or a nickel alloy or consists of copper or a copper alloy, and is preferably coated with a noble metal or conductive diamondlike carbon.

7 Claims, 5 Drawing Sheets

SNAP ELECTRODE, ITS BONDING METHOD AND USING METHOD

TECHNICAL FIELD

The present invention relates to an electrode for mounting a semiconductor and an electrode for connection of a flexible printed circuit (hereinafter also referred to as "FPC"). More specifically, it relates to an electrode for mounting (hereinafter also referred to as "connecting") an insertion-type semiconductor package or an electrode for connecting an FPC.

BACKGROUND ART

A semiconductor package (hereinafter also simply referred to as "package") is used for storing a semiconductor, protecting the semiconductor against the external environment and mounting the same on a printed board or the like. Such semiconductor packages are classified into a surface-mount type and an insertion-mount type depending on methods of mounting the same on substrates.

A surface-mount type package includes a BGA (Ball Grid Array), for example, which is mounted by directly soldering solder balls arranged on a base surface of the package at a constant interval in a latticelike manner to soldering patterns (mount pads) provided on the surface of a substrate. An insertion-mount type package includes a PGA (Pin Grid Array), for example, which is mounted by inserting pin electrodes vertically taken out from the package body into socket electrodes of a substrate. Following high integration and speed-up of hodiernal semiconductors as well as miniaturization/weight reduction of electronic devices, high-density mounting and miniaturization of semiconductors are required.

The surface-mount type package, allowing refinement of the soldering patterns on the surface of the substrate and the solder balls and mountable on either side of the substrate, has a structure easy to densify. If once mounted, however, the surface-mount type package having the base surface soldered to the substrate cannot be separated. In order to separate the package, the solder must be dissolved by heating, leading to such a problem that the overall device is badly influenced or re-mounting is inhibited due to deformation of the solder balls.

The insertion-mount type package allows multiplication of input/output pin electrodes as well as attachment/detachment of the package due to its structure. However, the socket electrodes receiving the pin electrodes manufactured by machining are so hard to miniaturize that the pin pitch is limited to about 500 μm to 1 mm. Further, the package manufactured by machining exhibits large dimensional dispersion, and requires a thickness of at least about 1 mm for attaining reliable electrical contact.

As to connection of an FPC, on the other hand, a connector prepared by covering an electrode formed by punching with a housing of resin is used for connecting FPCs or an FPC and a substrate such as a printed board with each other. In the FPC connector, however, refinement of the electrode size is limited due to machining, and it is difficult to miniaturize the connector and narrow the pitch of terminals due to securement of mechanical strength of the housing.

DISCLOSURE OF THE INVENTION

An object of the present invention is to provide an electrode for high-density connection capable of attachment/detachment of a package or an FPC. In order to attain this object, a snap electrode according to the present invention has a tubular ring presenting a circular or polygonal section and at least one spring electrode provided in this ring and coupled to this ring, to be connected to a substrate or an FPC by holding a pin electrode of an insertion-mount type package or the FPC with the spring electrode. The snap electrode preferably consists of nickel or a nickel alloy, or of copper or a copper alloy, and is preferably coated with a noble metal or conductive diamondlike carbon.

A method of bonding a snap electrode according to the present invention is a method of bonding a snap electrode having a tubular ring presenting a circular or polygonal section and at least one spring electrode provided in the ring and coupled to the ring by bonding only the ring part of the snap electrode and a substrate electrode or an electrode of an FPC with each other by ultrasonic bonding through gold or by soldering.

A method of using a snap electrode according to the present invention is a method of using a snap electrode having a tubular ring presenting a circular or polygonal section and at least one spring electrode provided in the ring and coupled to the ring by holding a pin electrode of an insertion-mount type package or an FPC with the spring electrode thereby connecting the snap electrode to a substrate or the FPC.

BEST MODE FOR CARRYING OUT THE INVENTION (Snap Electrode)

Figure 1A:
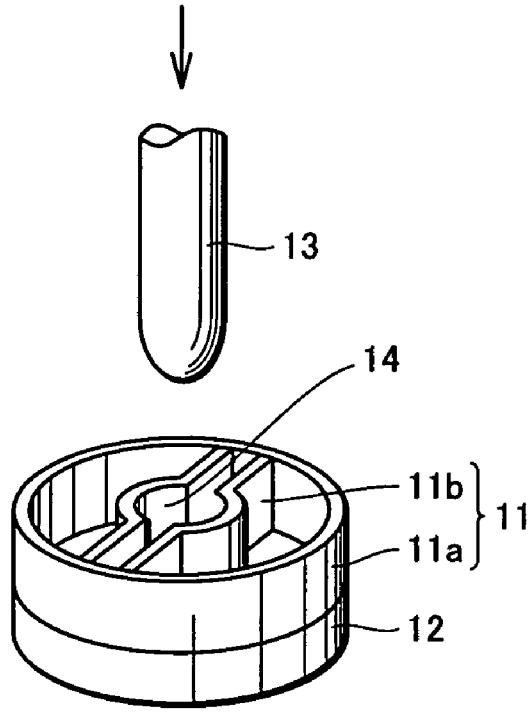
FIGS. 1A and 1B are perspective view showing a method of using a snap electrode according to the present invention.
Figure 1B:
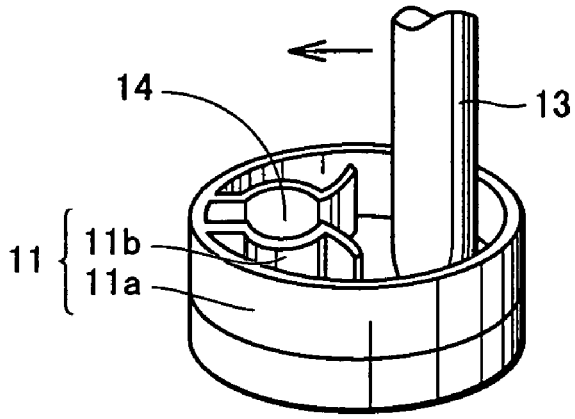

A snap electrode according to the present invention typically consists of a ring 11*a* and spring electrodes 11*b*, as shown in FIG. 1A or 1B. This snap electrode 11 is bonded to a substrate electrode 12 provided on a substrate such as a printed board or an electrode provided on an FPC. In order to connect an insertion-mount type package or an FPC to a substrate or another FPC, the spring electrodes 11*b* hold a pin electrode 13 of the insertion-mount type package or the FPC. While an electrode of a conventional socket for a PGA is protected by a plastic case, refinement is limited in this structure. The snap electrode according to the present invention implements a micro size by integrally forming the ring protecting the electrode around the spring electrodes.

In order to hold the pin electrode 13 with the spring electrodes 11*b*, the pin electrode 13 is inserted into a gap 14 formed by the spring electrodes 11*b* along arrow so that the pin electrode 13 is held with the spring electrodes 11*b* as shown in FIG. 1A, for example. Alternatively, the pin electrode 13 is inserted into the ring 11*a* and thereafter displaced along arrow so that the pin electrode 13 moved to a gap 14 formed by the spring electrodes 11*b* is held with the spring electrodes 11*b* as shown in FIG. 1B, for example.

The snap electrode according to the present invention can be effectively utilized for connecting an insertion-mount type package or an FPC to a substrate or another FPC. For example, the snap electrode can be utilized for mounting an insertion-mount type package on a substrate such as a printed board, connecting an FPC to a substrate, connecting an insertion-mount type package to an FPC or connecting an FPC to another FPC, for example.

The ring is a tubular body presenting a circular or polygonal section. The term "circular or polygonal section" denotes a circular or polygonal section obtained by cutting the tubular ring along a plane perpendicular to the longitudinal direction. The circular section includes not only a completely circular section but also an approximately circular section such as an elliptic section or a section having a partially distorted circumference, for example. The polygonal section, denoting a quadrangular or hexagonal section, for example, includes not only a regular-polygonal section but also a polygonal section provided with sides having different lengths. FIGS. 2A to 2F show exemplary circular rings 21*a*. FIGS. 2G to 2L show exemplary hexagonal rings 21*a*.

Figure 2A:
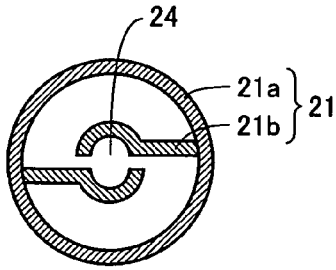
FIGS. 2A to 2L are sectional views showing the shapes of snap electrodes according to the present invention.
Figure 2B:
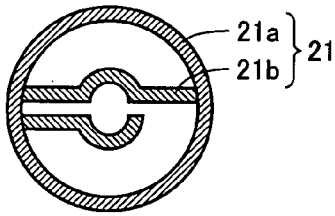
Figure 2C:
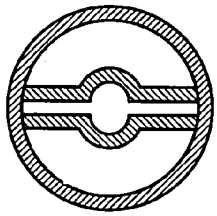
Figure 2D:
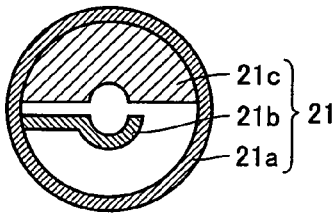
Figure 2E:
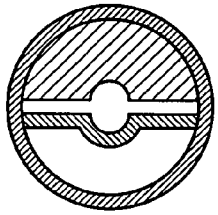
Figure 2F:
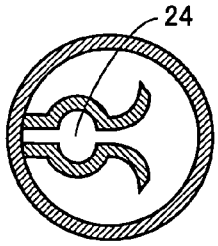
Figure 2G:
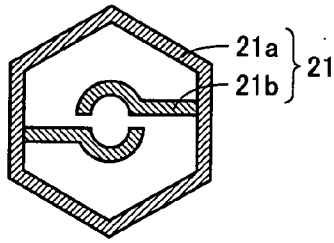
Figure 2H:
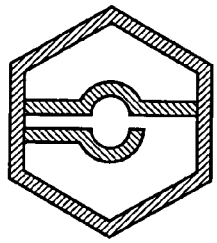
Figure 2I:
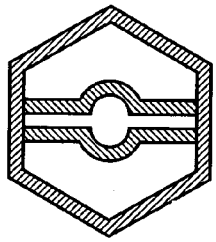
Figure 2J:
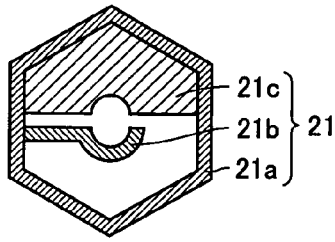
Figure 2K:
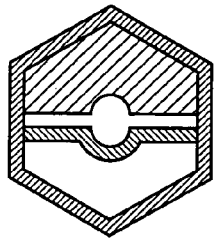
Figure 2L:
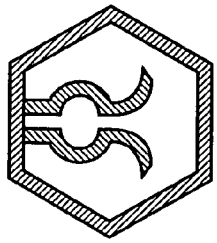

The ring has at least one spring electrode therein. The snap electrode provided with the spring electrode can hold a pin electrode of an insertion-type package or the like, to be connected to a substrate for attaining electrical and mechanical connection. The spring electrode is coupled to the ring. The spring electrode coupled to the ring can be protected when the snap electrode is manufactured, and a load applied to the spring electrode when receiving the pin electrode can be dispersed to the ring for protecting the spring electrode. FIGS. 2A to 2C, 2F, 2G to 2I and 2L show exemplary snap electrodes 21 each having a ring 21*a* and two spring electrodes 21*b*. FIGS. 2D, 2E, 2J and 2K show exemplary snap electrodes 21 each having a ring 21*a*, a spring electrode 21*b* and a filler 21*c* consisting of an electrode material provided on the upper half of the ring 21*a*. As to a gap 24 for engaging with the pin electrode, the present invention also includes such a mode that the gap 24 is located on a position slightly displaced from the central portion of the ring 21*a* in addition to a mode located on the central portion of the ring 21*a* as shown in FIG. 2A.

(Method of Manufacturing Snap Electrode)

The snap electrode according to the present invention is preferably manufactured by a method including steps of forming a resin mold by lithography and forming a layer consisting of a metallic material in the resin mold by electroforming. A socket electrode used for connection of an insertion-type package or the like, manufactured by machining, cannot be miniaturized but has an outer diameter of 500 μm to 1 mm and a thickness of about 1 mm at the minimum, and high-density connection of a semiconductor is limited due to these sizes. The snap electrode according to the present invention, manufactured by the method combining lithography and electroforming, can be reduced to an outer diameter of 50 μm to 500 μm and a thickness of 50 μm to 1 mm for enabling high-density connection. Further, the electrode for connection of an insertion-type package or the like allows attachment/detachment of the package. In addition, the snap electrode having the spring electrode coupled to the ring for protecting the spring electrode can be readily monolithically manufactured, with no requirement for assembling.

Figure 3A:
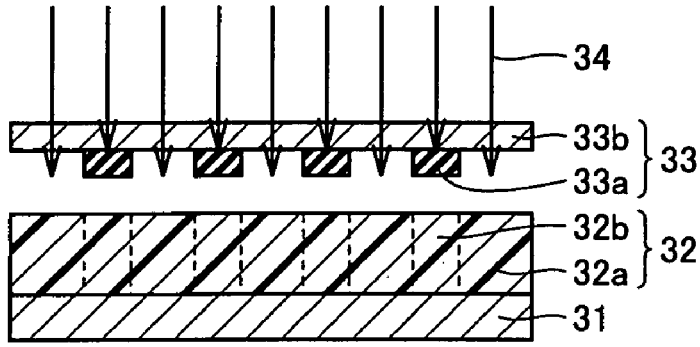
FIGS. 3A to 3E and FIGS. 4A to 4G are process drawings showing methods of manufacturing snap electrodes according to the present invention.

According to the method of manufacturing the snap electrode, a resin layer 32 for lithography is first formed on a conductive substrate 31, as shown in FIG. 3A. A metal substrate of copper, nickel or stainless steel or a silicon substrate formed by sputtering a metallic material such as titanium or chromium can be employed as the conductive substrate, for example. The material for forming the resin layer includes a resin material mainly composed of polymethacrylate ester such as polymethyl methacrylate (PMMA) or a chemically amplified resin material having X-ray sensitivity. The thickness of the resin layer can be arbitrarily set to 50 μm to 1 mm, for example, in response to the height of the snap electrode to be formed. The snap electrode can attain an effect (wiping effect) of scraping off soil adhering to the electrode for implementing electrically reliable connection when receiving the pin electrode by ensuring a certain degree of height.

Figure 3B:
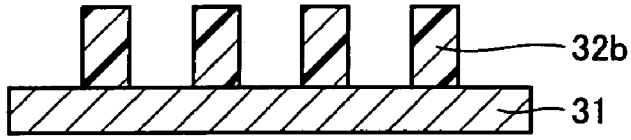

Then, a mask 33 is arranged on the conductive substrate 31, for applying X-rays 34 (or ultraviolet rays) through the mask 33. As to the X-rays, synchrotron radiation X-rays (hereinafter abbreviated as "SR") capable of implementing a high aspect ratio are preferable. The mask 33 has X-ray absorption layers 33*a* formed in response to a prescribed pattern of the snap electrode. Comparing a circular shape and a hexagonal shape with each other, for example, as to the shape of the ring constituting the snap electrode, the hexagonal shape allowing efficient arrangement on the mask is preferable to the circular shape. Light-transmittable bases 33*b* constituting the mask 33 can be prepared from silicon nitride, silicon, diamond or titanium, for example. The X-ray absorption layers 33*a* can be prepared from a heavy metal such as gold, tungsten or tantalum or a compound thereof, for example. When development is performed and parts 32*a* altered by the X-rays 34 are removed after application of the X-rays 34, a resin mold 32*b* shown in FIG. 3B is obtained.

Figure 3C:
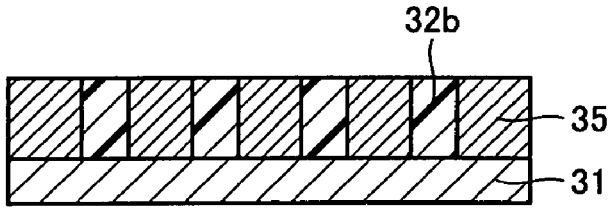

Then, electroforming is performed for depositing a metallic material 35 in vacancies of the resin mold 32*b*, as shown in FIG. 3C. The term "electroforming" denotes an operation of forming a layer consisting of a metallic material on a conductive substrate with a metal ionic solution. The conductive substrate 31 is employed as a plating electrode for performing electroforming so that the metallic material 35 can be deposited in the vacancies of the resin mold 32*b*, and the layer consisting of the deposited metallic material 35 finally forms the snap electrode. The metallic material can be prepared from nickel, copper or gold, an alloy thereof or permalloy, while nickel, copper, a nickel alloy or a copper alloy is preferable in the point that mechanical strength is large when and after a pin electrode of a package or the like is inserted and the point that the electrode exhibits high conductivity.

Figure 3D:
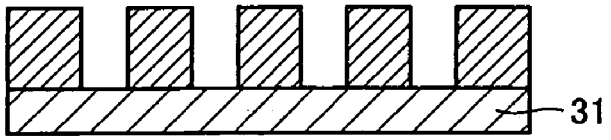

After the electroforming, a prescribed thickness is obtained by polishing or grinding, and the resin mold 32*b* is removed by wet etching or plasma etching (FIG. 3D). Then, the conductive substrate 31 is removed by wet etching with acid or alkali or by mechanical working, for obtaining a snap electrode shown in FIG. 3E.

As another method of manufacturing the inventive snap electrode, a method including steps of forming a resin mold by a metal mold and forming a layer consisting of a metallic material in the resin mold by electroforming can be used. A micro-sized snap electrode having an outer diameter of 50 μm to 500 μm and a thickness of 50 μm to 1 mm can be manufactured also by this method. This snap electrode has a structure obtained by coupling a spring electrode and a ring for protecting the spring electrode with each other, and can implement high-density connection of a semiconductor. Further, the electrode can be used as an electrode for an insertion-mount type package or an FPC, and allows attachment/detachment of the package or the FPC.

Figure 4A:
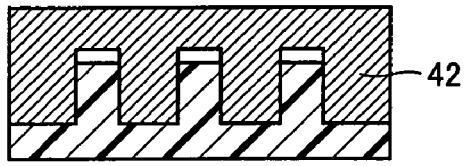
Figure 4B:
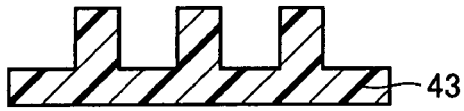

As shown in FIG. 4A, a concave resin body 43 shown in FIG. 4B is formed by pressing or molding such as injection molding with a mold 42 having projections. Thermoplastic resin such as acrylic resin such as polymethyl methacrylate or polyacetal resin such as polyurethane resin or polyoxymethylene, for example, can be employed as the resin. The mold 42, which is a microstructure similarly to the snap electrode according to the present invention, is preferably manufactured by lithography or the like.

Figure 4C:
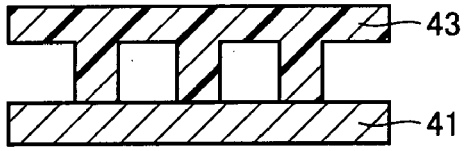
Figure 4D:
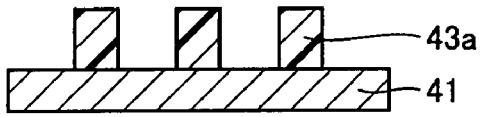
Figure 4E:
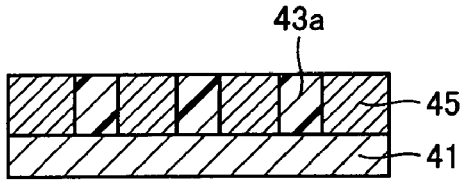
Figure 4F:
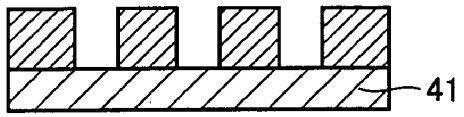
Figure 4G:
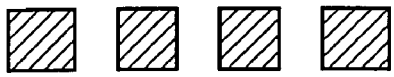

Then, the resin body 43 is vertically inverted and thereafter bonded to a conductive substrate 41, as shown in FIG. 4C. Then, the resin body 43 is polished for forming a resin mold 43*a*, as shown in FIG. 4D. Thereafter a metallic material 45 is deposited by electroforming (FIG. 4E) and the thickness is adjusted for thereafter removing the resin mold 43*a* (FIG. 4F) and removing the conductive substrate 41, thereby obtaining a snap electrode shown in FIG. 4G, similarly to the above.

The snap electrode is preferably coated with a noble metal such as gold, palladium or platinum for improving electrical contact and corrosion resistance. The surface of the snap electrode can be readily coated with gold or the like by barrel plating or the like. Alternatively, the snap electrode is preferably coated with conductive diamondlike carbon for improving abrasion resistance. When the snap electrode is coated with diamondlike carbon, a carbon film having a diamondlike crystal structure is formed on the surface of the snap electrode.

(Method of Bonding Snap Electrode)

Figure 5:
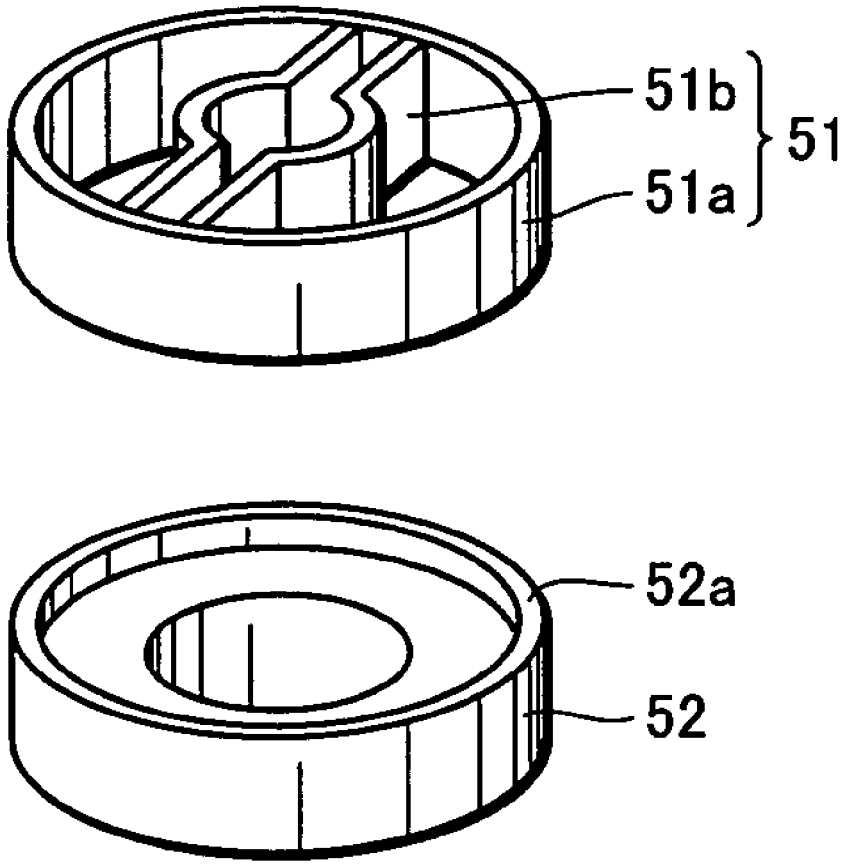
FIG. 5 is a perspective view showing a method of bonding a snap electrode according to the present invention.

A method of bonding the snap electrode according to the present invention is employed for bonding only the ring part of the aforementioned snap electrode and a substrate electrode or an electrode of an FPC with each other by ultrasonic bonding through gold or by soldering. Only the ring part of the snap electrode is bonded to the substrate electrode or the electrode of the FPC so that motion of the spring electrode can be smoothed when receiving the pin electrode by forming a gap between the substrate electrode or the electrode of the FPC and the spring electrode. In order to bond only the ring part of the snap electrode and a substrate electrode with each other, for example, a substrate electrode 52 having a projection 52*a* on a portion coming into contact with a ring 51*a* of a snap electrode 51 is so prepared that this substrate electrode 52 and the snap electrode 51 are bonded to each other, as shown in FIG. 5. Alternatively, only the portion of the substrate electrode coming into contact with the ring of the snap electrode is soldered for bonding these electrodes to each other.

As the bonding method, a method of performing ultrasonic bonding through gold or a method of performing bonding by soldering is preferable in the point that high conductivity and sufficient bonding strength can be attained. The ultrasonic bonding, ultrasonically applying vibration while pressing a contact surface in a solid-phase state for breaking an adsorption film or the like with its energy thereby attaining bonding, is preferable in the point that strong bonding is attained in a short time. The ultrasonic vibration frequency is preferably 10 kHz to 1000 kHz, and more preferably 10 kHz to 100 kHz. It is difficult to sufficiently break an absorption layer if the vibration frequency is smaller than 10 kHz, while there is a possibility of breakage due to high energy if the vibration frequency is larger than 1000 kHz. The pressurization condition is preferably 0.01 MPa to 100 MPa, and more preferably 0.01 MPa to 50 MPa. If the pressurization condition is smaller than 0.01 MPa, plastic deformation so readily takes place in the vicinity of the contact interface that sufficient bonding strength is hard to obtain. If the pressurization condition is larger than 100 MPa, on the other hand, there is an apprehension that the electrode is deformed and broken. The ultrasonic boding is preferably performed after coating both of the snap electrode and the substrate electrode or the like with gold, in order to attain sufficient conductivity and bonding strength.

(Method of Using Snap Electrode)

A method of using the snap electrode according to the present invention is characterized in that the said snap electrode is connected to a substrate or an FPC by holding a pin electrode of an insertion-mount type package or the FPC with the spring electrode. According to this using method, the snap electrode allows attachment/detachment of the package, and can implement high-density connection.

EXAMPLE 1

First, a resin layer 32 for lithography was formed on a conductive substrate 31, as shown in FIG. 3A. A silicon substrate obtained by sputtering titanium was employed as the conductive substrate. A copolymer of methyl methacrylate and methacrylic acid was employed as the material for forming the resin layer, and the thickness of the resin layer was set to 100 μm.

Then, a mask 33 was arranged on the conductive substrate 31, for applying X-rays 34 through the mask 33. SR was emitted from an SR-ring (NIJI-III) as the X-rays. A mask having X-ray absorption layers 33*a* consisting of a prescribed snap electrode pattern was used as the mask 33. Light-transmittable bases 33*b* constituting the mask 33 consisted of silicon nitride, and layers consisting of tungsten nitride were employed as the X-ray absorption layers 33*a*.

Development was performed with methyl isobutyl ketone after the application of the X-rays 34, and parts 32*a* altered by the X-rays 34 were removed for obtaining a resin mold 32*b* shown in FIG. 3B. Then, electroforming was performed for depositing a metallic material 35 in vacancies of the resin mold 32*b*, as shown in FIG. 3C. Nickel was employed as the metallic material.

Figure 3E:
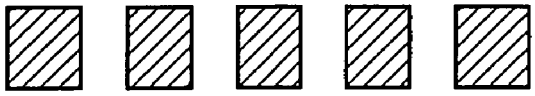

After the electroforming, surface irregularities were removed by polishing, thereafter the resin mold 32*b* was removed by oxygen plasma (FIG. 3D), and wet etching was thereafter performed with an NaOH aqueous solution for removing the conductive substrate 31, thereby obtaining a through-state snap electrode as shown in FIG. 3E.

As shown in FIG. 5, the obtained snap electrode 51 had a tubular ring 51*a* presenting a circular section, with two spring electrodes 51*b* provided in the ring 51*a*. Both ends of the spring electrodes 51*b* were coupled to the ring 51*a*. This ring 51*a* had an outer diameter of 200 μm and a height of 100 μm.

A substrate electrode 52 having a projection 52*a* in a portion coming into contact with the ring 51*a* of the snap electrode 51 as shown in FIG. 5 was prepared, the snap electrode 51 and the substrate electrode 52 were coated with gold by barrel plating, and the substrate electrode 52 was thereafter mounted on a printed board (not shown). Finally, the ring 51*a* of the snap electrode 51 and the projection 52*a* of the substrate electrode 52 were superposed with each other and ultrasonically bonded to each other (at 50 kHz and 30 MPa). Similarly, 30 sets of snap electrodes and substrate electrodes were mounted on the printed board.

A PGA having a pin pitch of 250 μm was mounted on the obtained printed board. This mounting was performed by inserting each pin electrode 13 into a gap 14 formed by each pair of spring electrodes 11*b* along arrow and holding the pin electrode 13 with the spring electrodes 11*b*, as shown in FIG. 1A. Consequently, electrical and mechanical connection was attained, and it was possible to attach/detach the PGA. While the outer diameter of the snap electrode was 200 μm in this Example, it has been clarified that further densified mounting is also possible since a snap electrode having an outer diameter of about 50 μm can also be manufactured.

EXAMPLE 2

A printed board was manufactured similarly to Example 1 except that a snap electrode 11 shown in FIG. 1B was employed in place of the snap electrode 51 shown in FIG. 5. The snap electrode 11 had a tubular ring 11*a* presenting a circular section, with two spring electrodes 11*b* provided in the ring 11*a*. The spring electrodes 11*b* according to this Example, having first ends coupled to the ring 11*a* and second ends not coupled to the ring 11*a* dissimilarly to the spring electrodes according to Example 1, exhibited larger movability as compared with the spring electrodes according to Example 1.

A PGA having a pin pitch of 250 μm was mounted on the obtained printed substrate. This mounting was performed by inserting each pin electrode 13 in the ring 11*a* and thereafter displacing the same along arrow for holding the pin electrode 13 moved to a gap 14 formed by the spring electrodes 11*b* with the spring electrodes 11*b*, as shown in FIG. 1B. Consequently, electrical and mechanical connection was attained, and it was possible to attach/detach the PGA.

Embodiments and Examples disclosed this time are to be considered as illustrative in all points and not restrictive. The scope of the present invention is shown not by the above description but by the scope of claim for patent, and it is intended that all modifications within the meaning and the range equivalent to the scope of claim for patent are included.

INDUSTRIAL AVAILABILITY

According to the present invention, an electrode for high-density connection capable of attachment/detachment of a package or an FPC can be provided. This electrode has small dimensional dispersion despite its small size, and requires no assembling.

The invention claimed is:

1. A snap electrode, having a tubular ring presenting a circular or polygonal section and one or two spring electrodes provided in said ring and coupled to said ring, to be connected to a substrate or a flexible printed circuit by holding a pin electrode of an insertion-mount type package or the flexible printed circuit with said spring electrode, wherein said spring electrode extends in a direction perpendicular to a central axis of said tubular ring and curves at a portion holding said pin electrode to form a gap for holding said pin electrode, and wherein said spring electrode bends in a direction perpendicular to a central axis of said tubular ring when said pin electrode is inserted.

2. The snap electrode according to claim 1, wherein said snap electrode consists of nickel or a nickel alloy.

3. The snap electrode according to claim 1, wherein said snap electrode consists of copper or a copper alloy.

4. The snap electrode according to claim 1, wherein said snap electrode is coated with a noble metal or conductive diamondlike carbon.

5. A method of bonding a snap electrode having a tubular ring presenting a circular or polygonal section and one or two spring electrodes provided in said ring and coupled to said ring by bonding only said ring part of the snap electrode and a substrate electrode or an electrode of a flexible printed circuit with each other by ultrasonic bonding through gold or by soldering, wherein said spring electrodes extend in a direction perpendicular to a central axis of said tubular ring and curve at a portion holding said pin electrode to form a gap for holding said pin electrode, and wherein said spring electrode bends in a direction perpendicular to a central axis of said tubular ring when said pin electrode is inserted.

6. A method of using a snap electrode having a tubular ring presenting a circular or polygonal section and one or two spring electrodes provided in said ring and coupled to said ring by holding a pin electrode of an insertion-mount type package or a flexible printed circuit with said spring electrode wherein said spring electrode extends in a direction perpendicular to a central axis of said tubular ring and curves at a portion holding said pin electrode to form a gap for holding said pin electrode, thereby connecting the snap electrode to a substrate or the flexible printed circuit, and wherein said spring electrode bends in a direction perpendicular to a central axis of said tubular ring when said pin electrode is inserted.

7. A snap electrode comprising:

a tubular ring having a circular or polygonal cross section; and a maximum of two spring electrodes situated within the ring and coupled thereto, the spring electrodes configured to be coupled to a substrate or flexible printed circuit by holding a pin electrode of an insertion-mount type package or the flexible printed circuit;

wherein at least one of the two spring electrodes extends in a direction perpendicular to a central axis of said tubular ring and comprises a straight portion and a curved portion, the curved portion configured to form a gap for holding the pin electrode in contact with the curved portion, and wherein said spring electrode bends in a direction perpendicular to a central axis of said tubular ring when said pin electrode is inserted.

* * * * *